United States Patent [19]

Brachet et al.

[11] 4,109,153

[45] Aug. 22, 1978

[54] VARIABLE-FLUENCE NEUTRON SOURCE

[75] Inventors: Guy Brachet, Breuillet; Pascal Demichel, Paris; Yvon Prigent, Marcoussis; Jean Charles Riche, Draveil, all of France

[73] Assignee: Commissariat a l'Energie Atomique, Paris, France

[21] Appl. No.: 749,166

[22] Filed: Dec. 9, 1976

[30] Foreign Application Priority Data

Dec. 17, 1975 [FR] France ..... 75 38734

[51] Int. Cl.[2] ..... G21G 4/02

[52] U.S. Cl. ..... 250/499; 250/432 R; 250/500

[58] Field of Search ..... 250/499, 500, 432, 381, 250/432 R

[56] References Cited

U.S. PATENT DOCUMENTS

| | | | |
|---|---|---|---|
| 2,592,115 | 4/1952 | Carroll | 250/499 |
| 3,571,595 | 3/1971 | Silver | 250/499 |
| 3,866,043 | 2/1975 | Freck | 250/435 |

*Primary Examiner*—Harold A. Dixon

*Attorney, Agent, or Firm*—Cameron, Kerkam, Sutton, Stowell & Stowell

[57] ABSTRACT

A source in which the neutron fluence can be varied makes use of a (α,n) reaction between a radioactive emitter in powdered form and a target in fluid form. The emitter is immersed in the target fluid between an upper and lower filter within a closed chamber. When the emitter rests on the lower filter in the quiescent state, radiation is limited by self-absorption and the source is in the state of minimum fluence. When the target fluid is circulated by means of a booster, the emitter is fluidized and maximum fluence is achieved. Variable intermediate values can be obtained by regulating the pressure and rate of circulation of the target fluid.

8 Claims, 2 Drawing Figures

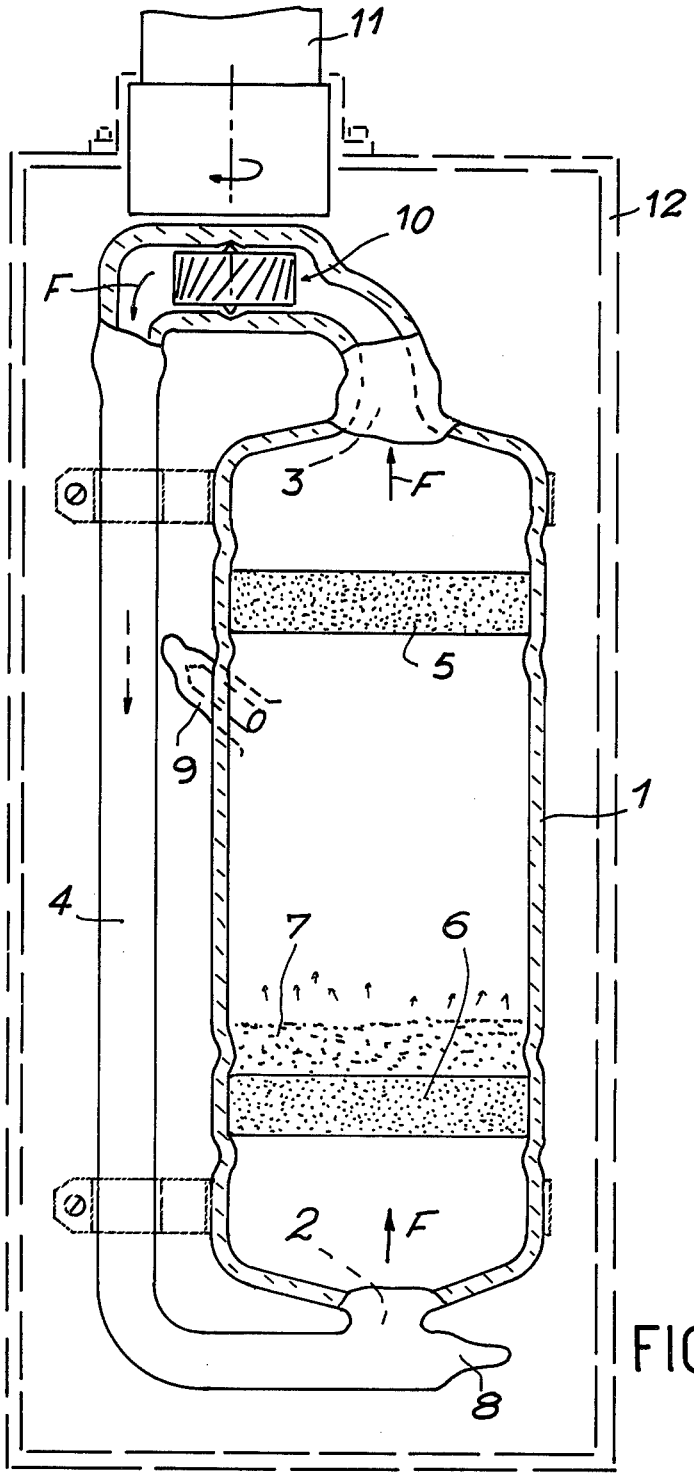
FIG.1
FIG.2
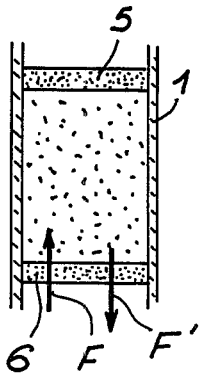

VARIABLE-FLUENCE NEUTRON SOURCE

This invention relates to a variable-fluence neutron source, that is, to a source in which the number of neutrons spontaneously emitted per second can vary between two different values, namely a minimum value and a maximum value.

The neutron source under consideration is of the type which operates on the known principle of a nuclear reaction between a radioactive emitter and a target in fluid form. The nuclear reaction employed in particular is of the $(\alpha,n)$ type.

Sources of this type are already known and widely used in the technology but they provide constant fluence in the majority of cases, which means by definition that they give rise to special shielding problems outside periods of actual use. In the case of a source employed for industrial applications of the type encountered in particular in detectors for locating oil layers by activation of deep-drilled rock formations, this disadvantage of constant fluence is sometimes highly objectionable.

It is for the reason just mentioned that a number of research workers have sought to develop variable-fluence sources which entail the use of different methods but are all based on the same principle, namely the use of an $\alpha$-emitter in the presence of a suitable target which can be either removed or withdrawn whenever the source is not in use. In point of fact, the devices conceived in the prior art are all of a mechanical type with moving parts and achieve only a limited neutron output. The reason for this is that, in order to obtain the lowest possible background in the shutdown position, it proves necessary to make use of devices which limit the maximum flux obtained, thereby restricting overall size to an appreciable extent and resulting in lifetimes which are often too short.

The present invention is concerned with a variable-fluence neutron source which provides a solution to the problems of the prior art mentioned in the foregoing, this result being achieved in a particularly simple manner by the means which have been adopted.

The aforesaid variable-fluence neutron source is distinguished by the fact that the emitter which is placed in powdered form within a closed chamber is immersed in a carrier fluid which constitutes the target and that provision is made for means whereby said emitter is fluidized by said carrier fluid within said chamber.

As a general rule, the powder which constitutes the emitter is placed within a chamber having an inlet and an outlet and a duct which provides a connection between said inlet and said outlet externally of said chamber. Inside the chamber, two filters located in the vicinity respectively of the inlet and of the outlet serve to limit the space in which the emitting powder is capable of moving, the assembly consisting of duct and chamber being filled with a fluid which constitutes the target of the neutron-generating nuclear reaction; in accordance with the invention, means are provided within the duct for circulating the target fluid in a closed loop and thus effecting fluidization of the emitting powder. These means usually consist of a vane-type booster which produces slight pressurization of the system or of any similar device of a type known per se. Said vane-type booster can be driven for example from the exterior of the chamber by means of a coupling system of the magnetic type, thus dispensing with the need for any penetration through the chamber wall and avoiding any problem of sealing against outleakage.

The foregoing considerations accordingly serve to explain the mode of operation of the neutron which forms the subject of the present invention and to demonstrate the ease with which it is possible to obtain a variation in fluence between its minimum value and its maximum value. In fact, when the device is at rest or in other words when the booster is not in operation, the powdered emitter rests on the lower filter of the chamber under the action of gravity. When an $\alpha$-emitter is employed as is most frequently the case, the phenomena of self-absorption of the radiation emitted within the interior of the compact powder layer are sufficient to ensure that the radiation from this latter to the fluid target which fills the chamber and the duct is reduced to a very low level and the source is then in its state of minimum fluence. On the contrary, if the booster is started up so as to cause fluidization of the powder and practically uniform distribution of this latter throughout the chamber within the space located between the two filters, there is thus achieved both intimate and maximum contact between each of the grains constituting the powder and the target fluid. It can be readily understood that, under these conditions, the state of maximum fluence of the source is accordingly achieved. By regulating the pressure and the rate of circulation of the target fluid within the installation, there is a further possibility of obtaining intermediate states which would correspond to variable values of fluence between the maximum and the minimum.

In the most usual forms of construction of the neutron source according to the invention, the powdered emitter is an $\alpha$-emitter which is selected from the group comprising curium, plutonium, thorium, actinium and americium, the half-lives of all these elements being of sufficient length (2 to 458 years) to ensure that the lifetime of the source is compatible with its industrial use. These different elements may in particular be employed in the form of oxides.

The target fluids which are in the gaseous state in the majority of instances are formed of compounds of light elements which give rise to nuclear reactions of the $(\alpha,n)$ type and are selected from the group comprising beryllium, boron, fluorine and Oxygen-18.

The use of a gaseous target fluid also makes it possible in some instances to increase the output of the source by putting the target gas under pressure within both the chamber and the duct.

Another particularly advantageous form of construction of the neutron source under consideration consists in the use of a powdered emitter consisting of Thorium-228 in conjunction with a target fluid consisting of strongly enriched water $H_2O$ (enriched for example with 80% Oxygen-18).

Finally, it is also an advantage in the majority of industrial forms of construction of the neutron source according to the invention to place the closed chamber which contains the powdered emitter and the target fluid within a protective casing in order to permit operation under environmental conditions which can sometimes be fairly severe (shocks and vibrations, temperatures, pressures, corrosion and so forth). As can readily be understood, said protective casing must itself be transparent to neutrons.

It has been noted earlier that, in accordance with the invention, it is only necessary to stop the booster motor in order to stop the neutron emission or rather in order to reduce this latter to the background level, with the result that the emitting powder progessively returns to the "quiescent bed" state. It may prove advantageous in some cases, however, to achieve the same result by reversing the direction of rotation of the booster motor since this has a tendency to apply the emitting powder rapidly against the lower filter. In experimental models designed solely for laboratory use, steps can also be taken to stop the neutron emission by discharging the target fluid or by causing the expansion of said fluid through an opening which has been formed in the chamber wall and which has not been permanently sealed-off.

A more complete understanding of the invention will in any case be gained from the following description of one example of construction which is not given in any limiting sense, reference being made to the accompanying drawings, in which:

FIG. 1 is a view in sectional elevation showing a neutron source in accordance with the invention;

FIG. 2 is an explanatory diagram showing the operation of the source of FIG. 1.

In FIG. 1, there is shown the chamber 1 of generally cylindrical shape and the openings 2 and 3 of the duct 4 which provide respectively an inlet to and an outlet from said chamber 1. In accordance with the invention, two filters consisting of an upper filter 5 and a lower filter 6 limit that portion of the chamber 1 in which an emitting radioactive powder is capable of moving, said powder being shown diagrammatically at 7. The entire assembly consisting of chamber 1 and duct 4 is filled with a fluid which emits neutrons under the action of radiations produced by the radioactive powder 7. There are also shown in FIG. 1 the openings 8 and 9 which served to introduce the fluid and the powder at the time of construction of the unit and which could also be employed in a laboratory model for the removal of said products if so required.

In accordance with the invention, a vane-type booster 10 is mounted within a slightly enlarged top portion of the duct 4 and is intended to be set in motion by a motor 11 with the aid of a magnetic coupling system between the shaft of said motor 11 and the shaft of the vane-type booster 10. The complete assembly consisting of chamber 1 and duct 4 is enclosed within a protective casing 12 through which the motor 11 passes. By way of example, the chamber 1 and the protective casing 12 can be constructed of stainless steel.

The operation of the variable-fluence neutron source shown in FIG. 1 is as follows: when there is no circulation of the emitting fluid, this latter forms a compact layer of powder under the action of gravity at the top portion of the lower filter 6; the nuclear emission of said powder is considerably reduced as a result of self-absorption and this consequently corresponds to minimum fluence of the neutron source which is illustrated. On the contrary, when the target fluid is caused to circulate in the direction of the arrows F (FIGS. 1 and 2) by means of the booster 10 which is driven in rotation by the motor 11, this accordingly results in a veritable suspension of particles of the emitting powder within that portion of the chamber 1 which is located between the two filters 5 and 6, thus forming a homogeneous fluidized bed in the target fluid. This is shown in FIG. 2, which corresponds to optimum distribution of the emitter within the target and consequently to maximum neutron output of the source and to the highest fluence of this latter. Should it be desired to stop the neutron radiation or at least to reduce this latter to its minimum value, it is possible either to suppress the circulation of the fluid and to allow the powder to fall back onto the lower filter 6 under the action of gravity or on the contrary to reverse the direction of rotation of the booster 10 and thus rapidly to apply the radioactive powder against said filter 6 as a result of circulation of the target fluid in the direction of the arrow F' (as shown in FIG. 2).

In accordance with the invention, the basic principle of operation of the source under consideration makes it possible, by controlling the rate of circulation of the target fluid within the source, to obtain a predetermined variation in neutron fluence between the minimum value corresponding to the background when the entire quantity of powder forms a compact layer on the lower filter 6 and the maximum fluence corresponding to the position of FIG. 2 when the entire quantity of powder is in suspension in the target fluid.

There will now be given three particular examples of utilization of the source shown in FIG. 1.

EXAMPLE 1

The ($\alpha$,n) reaction takes place between plutonium oxide and gaseous sulphur hexafluoride $SF_6$ employed as target fluid. The source comprises 17.5 g of $PuO_2$ in which the Pu has a content of 80% $Pu^{238}$. The powder employed has a particle size between 1 and 2 microns. The target gas employed occupies a volume of 60 $cm^3$ at a pressure of 275 bar. The plutonium oxide bed occupies a volume of 3.50 $cm^3$ at rest and a volume of 60 $cm^3$ in the fluidized form corresponding to optimum output and to maximum fluence of the source. The fluidization rate is of the order of a few mm per second and the source has a maximum fluence of $7 \times 10^7$ neutrons/-second.

EXAMPLE 2

The characteristics of the target gas are the same in the present source but the emitting powder consists of Curium-244 oxide, thus making it possible to reduce the quantity of powder to 3 g with respect to the previous example. The maximum fluence of the source is also $7 \times 10^7$ neutrons/second. The curium employed is 100% $Cm^{244}$.

EXAMPLE 3

In this example, the particular feature lies in the fact that a target fluid in liquid form is employed and constituted by 7.5 $cm^3$ $H_2O$ with a content of 80% $O^{18}$. The radioactive powder is constituted by 4.8 mg of $Th^{228}$ corresponding to a total activity of 4 curies and the maximum fluence of the source thus formed is $10^8$ neutrons/second.

What we claim is:

1. A variable-fluence neutron source utilizing a known reaction of the (a,n) type between a radioactive emitter and a target wherein the emitter is a powder within a closed chamber, a carrier fluid which constitutes the target, said powder in its normal quiescent bed state being sufficently compact so as to provide a self absorption of any generated radiation and means for fluidizing the powder emitter in said carrier fluid within said chamber by means for pumping said carrier fluid through a compact layer of the emitter powder for forming a fluidized suspension of the emitter powder from the layer in a homogeneous fluidized bed in said chamber to provide a neutron source of intensity varying with the pumping rate.

2. A variable-fluence neutron source utilizing a known reaction of the (a,n) type between a radioactive emitter and a target, wherein the emitter is a powder within a closed chamber, a carrier fluid which constitutes the target, and means for fluidizing the powder emitter in said carrier fluid within said chamber by passing said carrier fluid through a compact layer of the emitter powder and forming a suspension of the emitter powder from the layer in a homogenous fluidized bed in said chamber, said chamber having an inlet and an outlet, a duct being so arranged as to provide a connection between said inlet and said outlet externally of said chamber, the space in which the powder is capable of moving being limited by two filters which close said chamber respectively in the vicinity of said inlet and of said outlet, said duct being provided with means whereby the target fluid which fills said chamber and said duct is circulated in a closed loop in order to effect fluidization of the emitting powder.

3. A neutron source according to claim 2, wherein the means for effecting fluidization of the emitting powder are constituted by a vane-type booster which is driven from the exterior by means of a magnetic coupling system.

4. A neutron source according to claim 2, wherein the powdered emitter is an $\alpha$-emitter selected from the group comprising the oxides of curium, plutonium, thorium, actinium and americium and the target fluid is formed of compounds of light elements selected from the group comprising beryllium, boron, fluorine and Oxygen-18.

5. A neutron source according to claim 2, wherein the target fluid is a gas employed under pressure.

6. A neutron source according to claim 2, wherein the target fluid is water $H_2O$ strongly enriched with Oxygen-18.

7. A neutron source according to claim 6, wherein the powdered emitter is Thorium-228.

8. A neutron source according to claim 2 wherein the closed chamber which contains the powdered emitter and the target fluid is in turn placed within a protective casing.

* * * * *